US008438878B2

(12) United States Patent
Choi et al.

(10) Patent No.: US 8,438,878 B2
(45) Date of Patent: May 14, 2013

(54) CONTROL UNIT OF LAUNDRY PROCESSING APPARATUS

(75) Inventors: Cheol U. Choi, Changwon-si (KR); Dong Woo Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1057 days.

(21) Appl. No.: 12/089,827

(22) PCT Filed: Oct. 12, 2006

(86) PCT No.: PCT/KR2006/004112

§ 371 (c)(1), (2), (4) Date: Mar. 16, 2009

(87) PCT Pub. No.: WO2007/043819

PCT Pub. Date: Apr. 19, 2007

(65) Prior Publication Data

US 2010/0043499 A1 Feb. 25, 2010

(30) Foreign Application Priority Data

| | | |
|---|---|---|
| Oct. 12, 2005 | (KR) | 10-2005-0096135 |
| Oct. 12, 2005 | (KR) | 10-2005-0096136 |
| Oct. 12, 2005 | (KR) | 10-2005-0096137 |
| Oct. 12, 2005 | (KR) | 10-2005-0096138 |
| Oct. 12, 2005 | (KR) | 10-2005-0096139 |
| Oct. 12, 2005 | (KR) | 10-2005-0096140 |

(51) Int. Cl.
*B08B 3/12* (2006.01)
*D06F 37/00* (2006.01)

(52) U.S. Cl.
USPC ..... 68/3 R; 200/564

(58) Field of Classification Search ..... 200/564
See application file for complete search history.

(56) References Cited

U.S. PATENT DOCUMENTS

| | | | | |
|---|---|---|---|---|
| 2,742,015 | A | 4/1956 | Hoyle | 116/124 |
| 6,927,348 | B1 | 8/2005 | Schmidt et al. | |
| 2005/0077166 | A1 * | 4/2005 | Kim et al. | 200/564 |

FOREIGN PATENT DOCUMENTS

| | | |
|---|---|---|
| GB | 2 130 438 A | 5/1984 |
| JP | 2002312099 | 10/2002 |

(Continued)

OTHER PUBLICATIONS

Korean Notice of Allowance dated May 18, 2012 issued in Application No. 10-2005-0096139.

(Continued)

*Primary Examiner* — Michael Barr
*Assistant Examiner* — Jason Ko
(74) *Attorney, Agent, or Firm* — KED & Associates LLP

(57) ABSTRACT

A control unit of a laundry treatment apparatus is provided in which shaking of a knob may be reduced or prevented and a tactile manipulation response of the knob may be improved. The control unit may include a board provided in a control panel of the laundry treatment apparatus, an encoder mounted in the board and having a projected rotation shaft, a supporter mounted in the board or the control panel and having a hollow unit disposed outside the rotation shaft, a knob having a connecting shaft coupled to the rotation shaft, and a bushing mounted in the hollow unit and rotatably supporting at least one of the connecting shaft or the rotation shaft.

8 Claims, 10 Drawing Sheets

FOREIGN PATENT DOCUMENTS

| | | | |
|---|---|---|---|
| JP | 2004227855 | | 8/2004 |
| KR | 20020020329 | | 3/2002 |
| KR | 20040046987 | | 6/2004 |
| KR | 10-2004-0073771 | A | 8/2004 |
| KR | 10-2005-0012450 | A | 2/2005 |
| KR | 10-2005-0022909 | A | 3/2005 |
| KR | 10-2005-0022910 | A | 3/2005 |
| KR | 10-2005-0086200 | A | 8/2005 |
| KR | 10-2007-0040611 | A | 4/2007 |

OTHER PUBLICATIONS

Korean Office Action dated Jun. 22, 2012 issued in Application No. 10-2005-0096135.
Korean Notice of Allowance dated Jun. 22, 2012 issued in Application No. 10-2005-0096136.
Korean Notice of Allowance dated Dec. 5, 2012 issued in Application No. 10-2005-0096137.

* cited by examiner

CONTROL UNIT OF LAUNDRY PROCESSING APPARATUS

TECHNICAL FIELD

The present invention relates to a control unit of a laundry treatment apparatus and, more particularly, to a control unit of a laundry treatment apparatus, in which shaking of a knob can be prevented and a feeling of manipulation of the knob can be improved when the knob is manipulated.

BACKGROUND ART

In general, a laundry treatment apparatus is an apparatus for treating the laundry through processes, such as washing, rinse, dehydration and dry, in order to remove pollutants adhered on clothes, bedclothes and so on (hereinafter, referred to as "laundry") by means of water, a detergent and mechanical action. The laundry treatment apparatus includes a washing machine for washing the laundry, a drying machine for drying wet laundry, a combination dry and washing machine for washing and drying the laundry, and so on.

The laundry treatment apparatus is equipped with a control unit for receiving a laundry treatment method from a user and automatically controlling the operation of the laundry treatment apparatus according to the treatment method. The control unit includes a manipulation unit for allowing a user to input a variety of commands, and a display unit for displaying an operating status of the apparatus to the outside.

Accordingly, a user can directly control the operation of the machine through the manipulation unit or can properly set a control program of the control unit. The manipulation unit includes a variety of manipulation switches. The manipulation switch can include a press switch, a slide switch, a rotary switch and so on according to a manipulation method. A representative rotary switch is a knob switch.

The knob switch includes a cylindrical knob rotatably disposed in the manipulation unit, and an encoder connected to the rotation center of the knob and configured to generate different control signals according to rotation angles of the knob.

The knob is rotatably disposed in a control panel forming the appearance of the control unit. The encoder is mounted in a board provided within the control unit, and has a rotation axis coupled to the knob. Space exists between the control panel and the board. Thus, the rotation axis of the encoder is lengthily projected toward the knob. A connecting shaft is lengthily projected toward the encoder in the rear of the knob and is then connected to the rotation axis.

In the knob switch of the conventional control unit, however, the rotation axis and the connecting shaft are lengthily formed and are connected to each other. Accordingly, there is a problem in that the connection structure of the encoder and the knob is very unstable. That is, problems arise because the connecting portion of the encoder and the knob is easily shaken and is easily broken by external shock, shaking, etc.

Accordingly, in recent knob switches, a thickness of each of the rotation axis and the connecting shaft is increased and structures, such as a reinforcement rib, are also added in order to reinforce the connecting portion of the encoder and the knob. Alternatively, an additional support member adhered closely to the outer circumferential surfaces of the rotation axis and the connecting shaft is added.

However, if the connecting portion of the rotation axis and the connecting shaft is reinforced as described above, there are problems in that the material cost increases and the fabrication of parts is difficult. Further, if the support member to support the rotation axis and the connecting shaft is provided, there is a problem in that upon rotation of the knob, frictional noise is generated due to the frictional action of the support member or a feeling of manipulation is greatly lowered.

DISCLOSURE OF INVENTION

Technical Problem

The present invention provides a control unit of a laundry treatment apparatus, wherein shaking of a knob upon manipulation of the knob can be prevented and a feeling of manipulation of the knob can be improved.

Technical Solution

In order to accomplish the above object, the present invention provides a control unit of a laundry treatment apparatus, including a board provided in a control panel of the laundry treatment apparatus, an encoder mounted in the board and having a projected rotation shaft, a supporter mounted in the board or the control panel and having a hollow unit disposed outside the rotation shaft, a knob having a connecting shaft coupled to the rotation shaft, and a bushing mounted in the hollow unit and rotatably supporting at least one of the connecting shaft and the rotation shaft.

The bushing may include plastic or metal having a lubricative property. The bushing may comprise a mounting unit mounted in the hollow unit, and a contact unit extending from the mounting unit and rotatably coming in contact with the connecting shaft or the rotation shaft. In this case, the mounting unit may comprise an outer circumference unit disposed on an outer circumference of the hollow unit, and a connection unit connecting the outer circumference unit and the contact unit. Alternatively, the mounting unit may comprise an outer circumference unit disposed on an outer circumference of the hollow unit, a inner circumference unit disposed on an inner circumference of the hollow unit, and a connection unit connecting the outer circumference unit and the inner circumference unit, and the contact unit. The mounting unit may have a plurality of incision units formed therein in a circumference direction with the incision units being spaced apart from each other.

The contact unit may resiliently support the connecting shaft or the rotation shaft. The contact unit may be inclined from the mounting unit to the connecting shaft or the rotation shaft. The contact unit may include a rib projected toward the connecting shaft or the rotation shaft along an inner circumference of the mounting unit. A slot may be formed at the end of the contact unit.

Furthermore, according to another aspect of the present invention, a control unit of a laundry treatment apparatus includes a board provided in a control panel of the laundry treatment apparatus, a supporter mounted in the board or the control panel and disposed to allow the rotation shaft to pass therethrough, a knob coupled to the rotation shaft, and a resilient support member provided in the supporter or the knob in order to support the knob resiliently and rotatably.

The resilient support member may include plastic or metal having a lubricative property. The resilient support member may include a resilient unit having one side coupled to one of the supporter and the knob, and the other side inclinedly extending toward the other of the supporter and the knob. A projection unit coming in contact with the supporter or the knob may be formed in the resilient unit. The resilient unit may be disposed in plural numbers around the rotation shaft of the encoder. The resilient support member may further include a mounting unit, which is detachably mounted in any one of the supporter and the knob and to which one side of the resilient unit is coupled.

Further, according to still another aspect of the present invention, a control unit of a laundry treatment apparatus includes an encoder mounted in a board and having a projected rotation shaft, a supporter mounted in the board or a control panel, a knob rotatably disposed in the supporter, a hollow unit formed in the supporter and having the rotation shaft disposed therein, and a connecting shaft formed in the knob, coupled to the rotation shaft, and partially coming in contact with the hollow unit.

A lubricant may be provided between the hollow unit and the connecting shaft. An opposite surface of the hollow unit and the connecting shaft may have a diameter that decreases in a direction in which the connecting shaft is inserted. A contact unit of the hollow unit and the connecting shaft may include a projection formed in an opposite surface of one of the hollow unit and the connecting shaft and coming in contact with an opposite surface of the other of the hollow unit and the connecting shaft. A non-contact unit of the hollow unit and the connecting shaft may include a groove unit formed on a circumference on at least one surface of an opposite surface of the hollow unit and the connecting shaft. The non-contact unit may be formed in plural numbers in the hollow unit or the connecting shaft in either an axial direction or a length direction with the non-contact units being spaced apart from each other.

ADVANTAGEOUS EFFECTS

The control unit of the laundry treatment apparatus according to the present invention is advantageous in that a problem in which a knob is shaken or inclined can be solved because the knob or an encoder is stably supported by a supporter, and a friction phenomenon can be reduced and a feeling of manipulation of the knob can be improved because the contact area of the supporter and the knob is reduced.

BEST MODE FOR CARRYING OUT THE INVENTION

The present invention will now be described in connection with embodiments with reference to the accompanying drawings.

Figure 1:
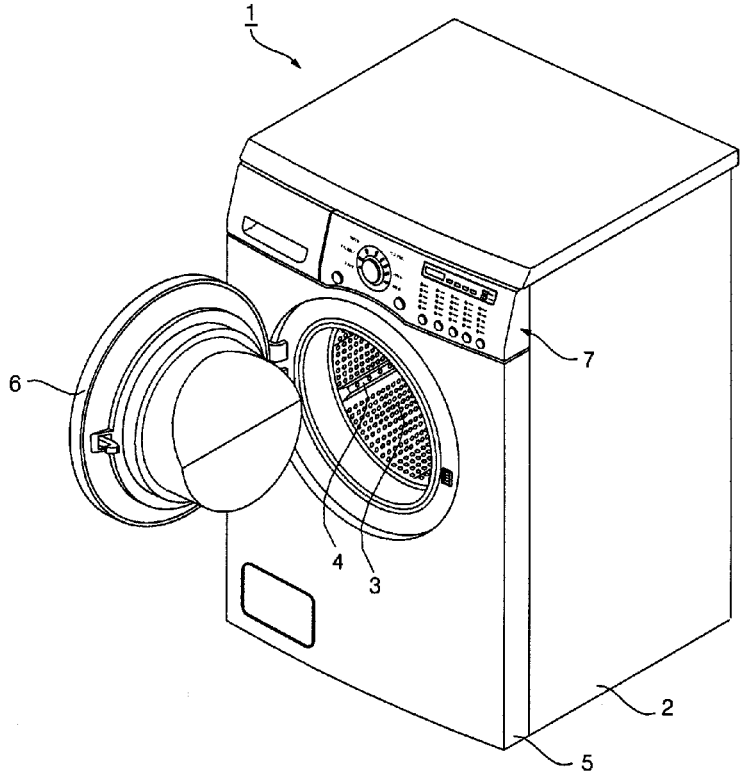
FIG. 1 is a perspective view of a laundry machine of a general laundry treatment apparatus.

FIG. 1 is a perspective view of a drum washing machine 1 for washing the laundry, of a general laundry treatment apparatus. The drum washing machine 1 includes a cabinet 2 having a front side opened, a tub disposed within the cabinet 2 and configured to contain wash water, a drum 3 rotatably disposed within the tub, configured to contain the laundry, and having holes through which the wash water can pass formed therein, a plurality of lifters 4 disposed on the inner surface of the drum 3 and configured to draw up the laundry up to a height when the drum 3 is rotated and to drop the laundry by means of gravity, a driving motor mounted in the tub and configured to rotate the drum 3, a cabinet cover 5 disposed at the front of the cabinet 2 and having a laundry inlet port through which the laundry can enter formed therein, a door 6 rotatably disposed in the cabinet cover 5 and configured to open and shut the laundry inlet port, and a control unit 7 mounted on a front upper side of the cabinet 2 and configured to manipulate and control the operation of the drum washing machine 1.

Figure 2:
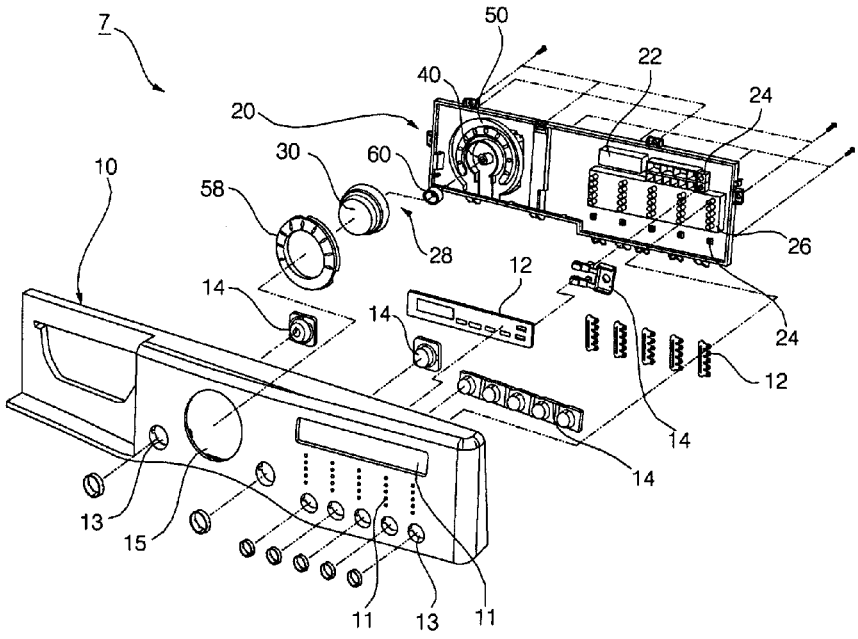
FIG. 2 is a dismantled perspective view illustrating a control unit of the laundry machine according to an embodiment of the present invention.
Figure 3:
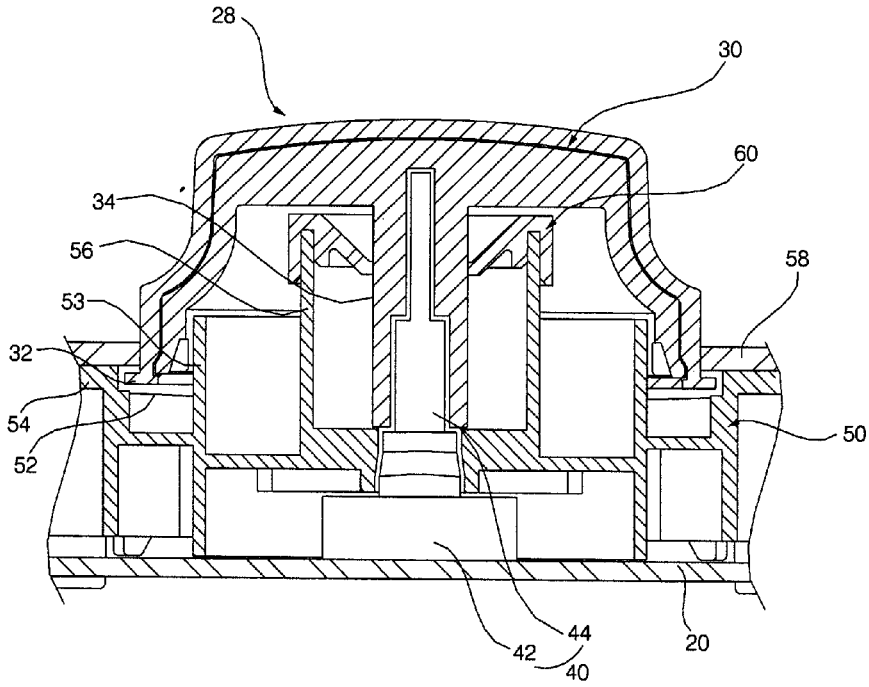
FIG. 3 is a cross-sectional view of a knob switch shown in FIG. 2.
Figure 4:
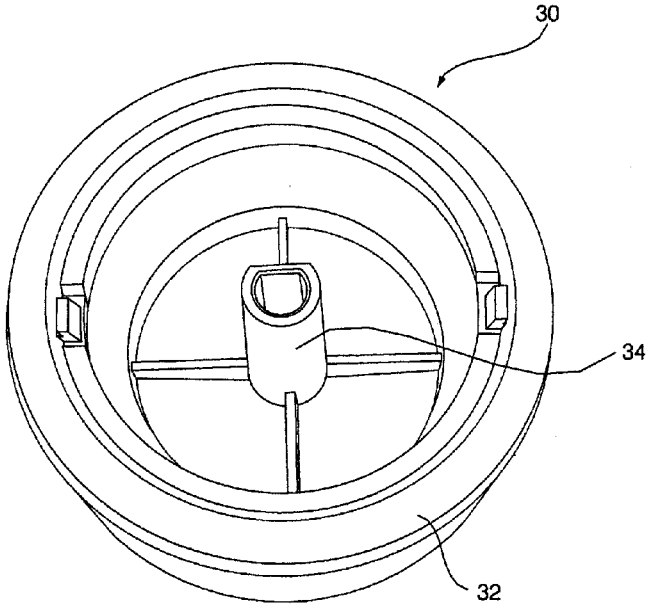
FIG. 4 is a perspective view of a knob shown in FIG. 3.
Figure 5:
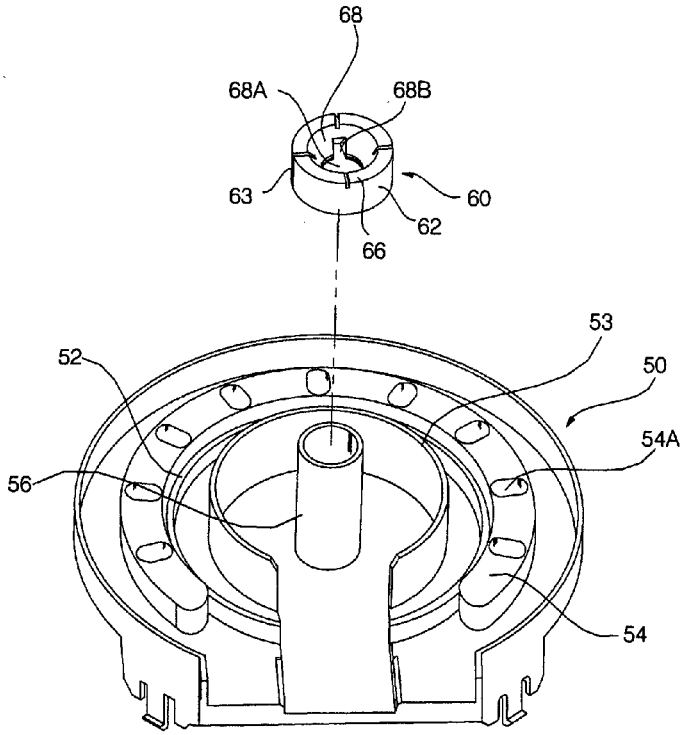
FIG. 5 is a dismantled perspective view of a supporter and a bushing shown in FIG. 3.
Figure 6:
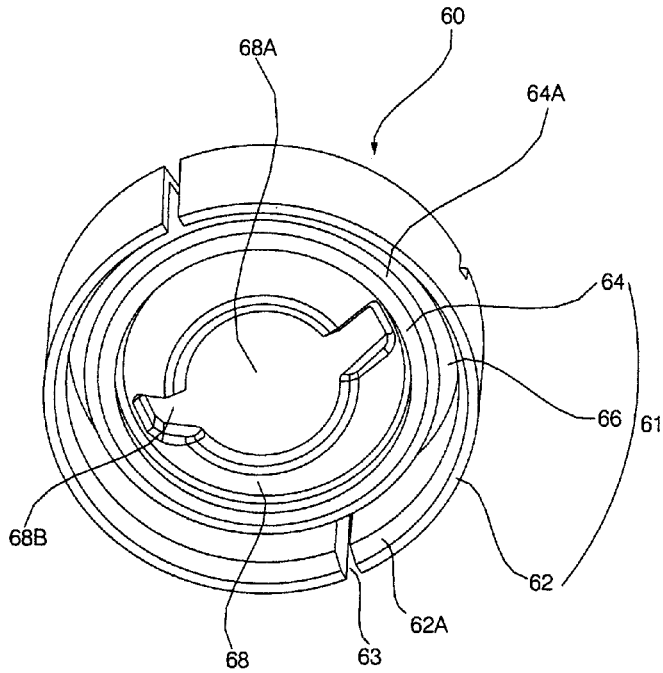
FIG. 6 is a perspective view of the bushing shown in FIG. 3.

FIG. 2 is a dismantled perspective view illustrating the control unit 7 of the washing machine 1 according to an embodiment of the present invention. FIG. 3 is a cross-sectional view of a knob switch 28 shown in FIG. 2. FIG. 4 is a perspective view of a knob 30 shown in FIG. 3. FIG. 5 is a dismantled perspective view of a supporter 50 and a bushing 60 shown in FIG. 3. FIG. 6 is a perspective view of the bushing 60 shown in FIG. 3.

Referring to FIG. 2, the control unit 7 comprises a control panel 10 detachably mounted in the cabinet 2 and the cabinet cover 5 and forming the appearance of the control unit 7, and a board 20 disposed within the control panel 10 and having various components for controlling the operation of the drum washing machine 1 mounted therein. The control panel 10 has a display hole 11, a plurality of button holes 13, and a knob hole 15. The display hole 11 has a transparent window 12, made of transparent material, mounted therein. Buttons 14 are disposed in the button holes 13 so that they can be pressed. In the board 20 is mounted a display member 22 at a location opposite to the transparent window 12, and a tact switch 24 at locations opposite to the buttons 14.

The display member 22 is a component for display, such as a LCD or a LED, and serves to display the operating status of the drum washing machine 1 to a user through the transparent window 12. The tact switch 24 is an ON/OFF switch, and controls the operation of the drum washing machine 1 while being turned on or off as the button 14 is pressed. A LED supporter 26 for supporting the LED and guiding light of the LED into the transparent window 12 is mounted on a front surface of the board 20.

A knob switch 28 is installed at a portion corresponding to the knob hole 15 of the board 20. The knob switch 28 is a rotary switch that controls the encoder 40 to generate different signals according to angles where the knob 30 is rotatably manipulated, thus controlling the operation of the drum washing machine 1 in various ways.

Referring to FIGS. 3 to 6, the knob switch 28 includes a knob 30 that is disposed to penetrate the knob hole 15 and is rotatably manipulated, an encoder 40 configured to generate a variety of control signals according to rotation angles, and having a rotation shaft 44 mounted on the board 20 and connected to a connecting shaft 34 of the knob 30, a supporter 50 mounted on the board 20 between the encoder 40 and the knob 30, and a bushing 60 mounted on the supporter 50 and configured to rotatably at least one of the connecting shaft 34 and the rotation shaft 42.

Referring to FIGS. 3 and 4, the knob 30 is rotatably seated at the front of the supporter 50 and projects forward from the control panel 10. A flange unit 32 projects outward around the circumference of the knob 30 at the rear end of the knob 30 such that it is stably seated at the front of the supporter 50. Further, a connecting shaft 34 coupled to a rotation shaft 44 of the encoder 40 projects rearward at the rear center of the knob 30.

The encoder 40 includes a main body 42 mounted on the board 20, and the rotation shaft 44 rotatably disposed in the main body 42 and coupled to the connecting shaft 34 of the knob 30. The connecting shaft 34 has a hollow portion formed at its center so that the end of the rotation shaft 44 is pressed fit into the hollow portion of the connecting shaft 34. The hollow portion of the connecting shaft 34 and the rotation shaft 44 have a cross section other than a circle so that rotatory power of the knob 30 can be smoothly transferred to the rotation shaft 44.

Referring to FIGS. 3 and 5, the supporter 50 includes a sliding seating unit 52 formed at the front and having the flange unit 32 of the knob 30 rotatably seated therein, and a LED support unit 54 circularly disposed outside the sliding seating unit 52 and configured to support a plurality of LEDs. A guide rib 53 for guiding the rotation of the knob 30 projects in a circumference direction within the sliding seating unit 52.

A hollow unit 56 through which the rotation shaft 44 and the connecting shaft 34 can pass projects forward at the center of the sliding seating unit 52. The hollow unit 56 has a diameter greater than that of the connecting shaft 34 and the rotation shaft 44 such that the connecting shaft 34 or the rotation shaft 44 can be easily inserted into the hollow unit 56.

Further, the LED support unit 54 projects forward around the outer circumferential surface of the sliding seating unit 52 in such way to guide the rotation of the knob 30 in the same manner as the guide rib 53. A plurality of LED holes 54A in which the LEDs for displaying the rotation angle of the encoder 40 are disposed are formed in the LED support unit 54 in the circumference direction with them being spaced apart from each other. The LED holes 54A support the LEDs disposed in the board 20, and guide light of the LEDs into a desired direction. A ring-shaped transparent window 58 through which the light of the LEDs is projected is disposed at the front of the LED support unit 54.

Referring to FIG. 3, a bushing 60 that rotatably and resiliently supports the connecting shaft 34 is mounted in the hollow unit 56. The bushing 60 can also rotatably support the rotation shaft 44 resiliently. The bushing 60 can have a circular cap structure inserted into the end of the hollow unit 56, and allows the connecting shaft 34 to pass through its center.

Referring to FIGS. 5 and 6, the bushing 60 includes a mounting unit 61 mounted in the hollow unit 56, and a contact unit 68 extending from the mounting unit 61 and re-siliently rotatably supporting the connecting shaft 34.

The mounting unit 61 includes an outer circumference unit 62 closely adhered on the outer circumferential surface of the hollow unit 56, an inner circumference unit 64 adhered closely to the inner circumferential surface of the hollow unit 56, and a connection unit 66 connecting the outer circumference unit 62, the inner circumference unit 64 and the contact unit 68. The outer circumference unit 62 and the inner circumference unit 64 are spaced apart from each other at a distance smaller than a thickness of the hollow unit 56 so that the end of the hollow unit 56 can be pressed into the outer circumference unit 62 and the inner circumference unit 64.

Inclined surfaces 62A and 64A are formed at the rear inner surface or the outer circumference unit 62 or at the rear outer surface of the inner circumference unit 64 at a specific angle so that the hollow unit 56 can be easily inserted between the outer circumference unit 62 and the inner circumference unit 64. In this case, the inner circumference unit 64 may be omitted, if needed.

Meanwhile, an incision unit 63 for compensating for dimension error of the hollow unit 56 and the bushing 60 when the bushing 60 is mounted is formed in at least one of the outer circumference unit 62 and the connection unit 66. The incision unit 63 is a slit lengthily cut in a radial direction, and is widened or closed up in a circumference direction when the bushing 60 is mounted, thus compensating for dimension error of the hollow unit 56 and the bushing 60. A plurality of the incision units 63 are spaced apart from each other in the outer circumference unit 62 and the connection unit 66 in a circumference direction.

The contact unit 68 projects inclinedly from the connection unit 66 of the mounting unit 61 to the connecting shaft 34 so that it resiliently supports the connecting shaft 34. The contact unit 68 is a rib that is projected inward along the inner circumferential surface of the inner circumference unit 64. An insertion hole 68A into which the connecting shaft 34 is inserted is formed at the center of the contact unit 68. That is, the contact unit 68 has a funnel structure at the center of which the insertion hole 68A is formed. It is preferred that the insertion hole 68A be formed to be the same as or slightly smaller than the outside diameter of the connecting shaft 34 so that it can be adhered closely to the connecting shaft 34.

The contact unit 68 is inclined rearward from the inner circumference unit 64 to the insertion hole 68A so that the connecting shaft 34 can be easily inserted. That is, the contact unit 68 has an outer end integrally coupled to the inner circumferential surface of the inner circumference unit 64 and an inner end, forming the insertion hole 68A, which is located on the rear side compared with the outer end.

A plurality of slots 68B are formed at the inner end of the contact unit 68 along the circumference of the insertion hole 68A with them being spaced apart from each other at the same angle such that the insertion hole 68A is resiliently widened when the connecting shaft 34 is inserted into the insertion hole 68A. The slot 68B is lengthily formed in a radial direction at the inner end of the contact unit 68.

Meanwhile, the bushing 60 includes plastic or metal having a lubricative property and an abrasion-resistant property. In the present embodiment, the bushing 60 is injected and molded using polyacetal resin (POM, polyoxymethylene).

An assembly process and operation of the control unit 7 constructed above according to an embodiment of the present invention are described below.

The LEDs, the LED supporter 26, the tact switch 24, the display member 22, the encoder 40, and so on are mounted at the front surface of the board 20. The LED supporter 26 and the supporter 50 are mounted in a portion in which the LEDs and the encoder 40 are mounted.

In the supporter 50, the LEDs are inserted into the LED holes 54A of the LED support unit 54, and the rotation shaft 44 of the encoder 40 is inserted into the hollow portion of the hollow unit 56. Accordingly, the LEDs can be stably supported by the LED support unit 54 of the supporter 50 and can have its light radiated in a desired direction.

The bushing 60 is inserted into the end of the hollow unit 56. At this time, the end of the hollow unit 56 is pressed between the outer circumference unit 62 and the inner circumferential surface 64 of the bushing 60, the outer circumference unit 62 is adhered closely to the outer circumferential surface of the hollow unit 56, and the inner circumferential surface 64 is adhered closely to the inner circumferential surface of the hollow unit 56.

If, when the bushing 60 is mounted, there is dimension error in the bushing 60 and the hollow unit 56, the incision units 63 of the bushing 60 compensate for the dimension error of the hollow unit 56 and the bushing 60 while being widened and closed up in the circumference direction. Accordingly, it is not necessary to fabricate the bushing 60 and the hollow unit 56 with high accuracy, so that the bushing 60 and the supporter 50 can be fabricated simply. Further, since the bushing 60 can be easily mounted in the hollow unit 56, the assembly work of the knob switch 28 can be performed conveniently.

Furthermore, the knob 30 is rotatably seated in the front of the supporter 50. The flange unit 32 of the knob 30 is slidingly seated in the sliding seating unit 52 of the supporter 50. The connecting shaft 34 of the knob 30 is inserted into the insertion hole 68A formed in the contact unit 68 of the bushing 60 and is then rotatably disposed within the hollow unit 56. If the connecting shaft 34 is inserted into the hollow unit 56, the rotation shaft 44 of the encoder 40 is inserted into the hollow unit of the connecting shaft 34 and fixed thereto.

However, the insertion hole 68A has a diameter, which is the same as or smaller than that of the connecting shaft 34. Thus, the inner end of the contact unit 68 is resiliently deformed in a direction where it is widened around the slot 68B formed in the insertion hole 68A as the connecting shaft 34 is inserted into the insertion hole 68A. Accordingly, the inner end of the contact unit 68 is resiliently adhered closely to the outer circumferential surface of the connecting shaft 34.

Further, the inside diameter of the hollow unit 56 is greater than the outside diameter of the connecting shaft 34. Thus, when the knob 30 is assembled, the connecting shaft 34 can be inserted into the hollow unit 56 conveniently, and when the knob 30 is rotatably manipulated, the hollow unit 56 and the connecting shaft 34 are not brought in contact with each other, thus preventing the occurrence of frication.

If the inner end of the contact unit 68 is resiliently adhered closely to the outer circumferential surface of the connecting shaft 34, the connecting shaft 34 is resiliently supported at a fixed position while being rotatably supported by the bushing 60. Accordingly, when the knob switch 28 is assembled, the knob 30 can be prevented from going down due to weight, and when the knob switch 28 is manipulated, the knob 30 can be prevented from being fluctuated up and down, and left and right directions due to external shock, vibration, etc.

Furthermore, the knob 30 resiliently returns to a normal position after its shock or vibration is absorbed by the bushing 60. As the knob 30 is resiliently supported by the bushing 60 as described above, the hollow unit 56 and the connecting shaft 34 can be formed in different diameters with them being space apart from each other.

In addition, while the inner end of the bushing 60 linearly touches the outer circumferential surface of the connecting shaft 34, the bushing 60 is formed from polyacetal resin having a good lubricative property, etc. Therefore, when the knob 30 is rotatably manipulated, a frication action between the knob 30 and the supporter 50 can be reduced significantly. Accordingly, the occurrence of noise and a reduction in a feeling of manipulation, which are incurred by friction between the knob 30 and the supporter 50, can be prevented.

Thereafter, the transparent window 12 is installed at the display hole 11 of the control panel 10. The button 14 is resiliently installed at each of the button holes 13. The board 20 is mounted on the rear surface of the control panel 10, so that the display member 22 and the tact switch 24 are disposed at the rears of the transparent window 12 and the button holes 13, respectively. At this time, the front side of the knob 30 is inserted into the knob hole 15 of the control panel 10, and the transparent window 58 is disposed between the knob 30 and the knob hole 15.

Figure 7:
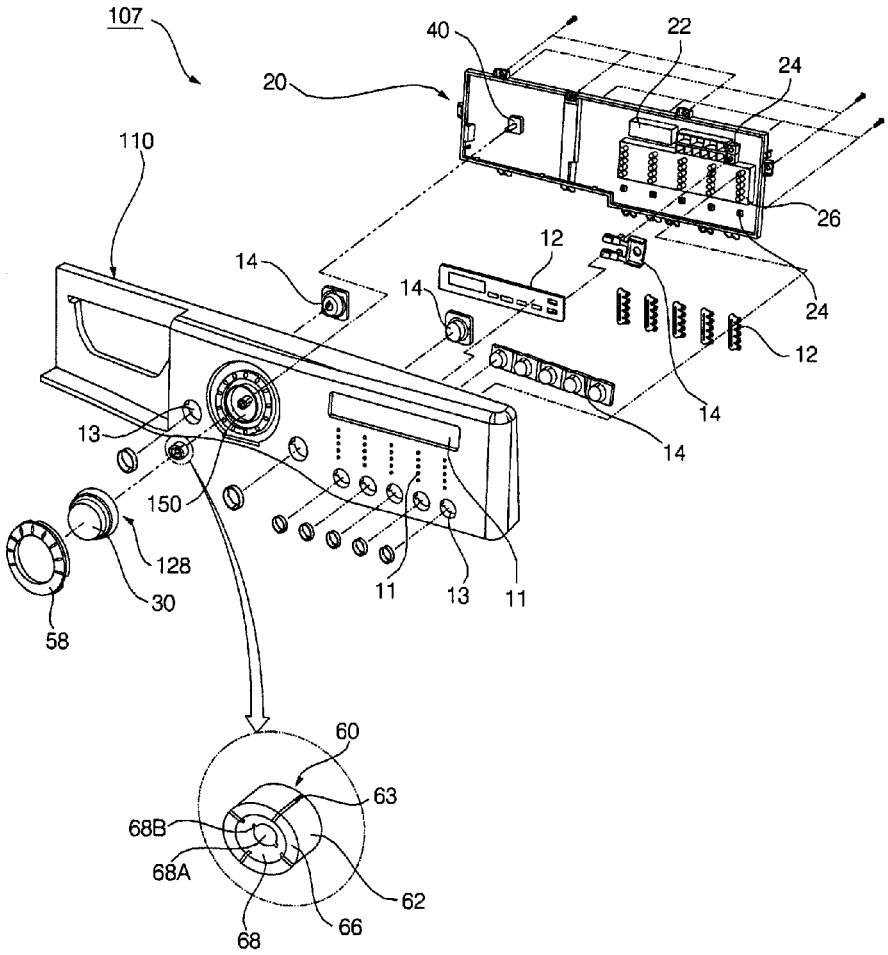
FIG. 7 is a dismantled perspective view of a control unit of a laundry machine according to another embodiment of the present invention.
Figure 8:
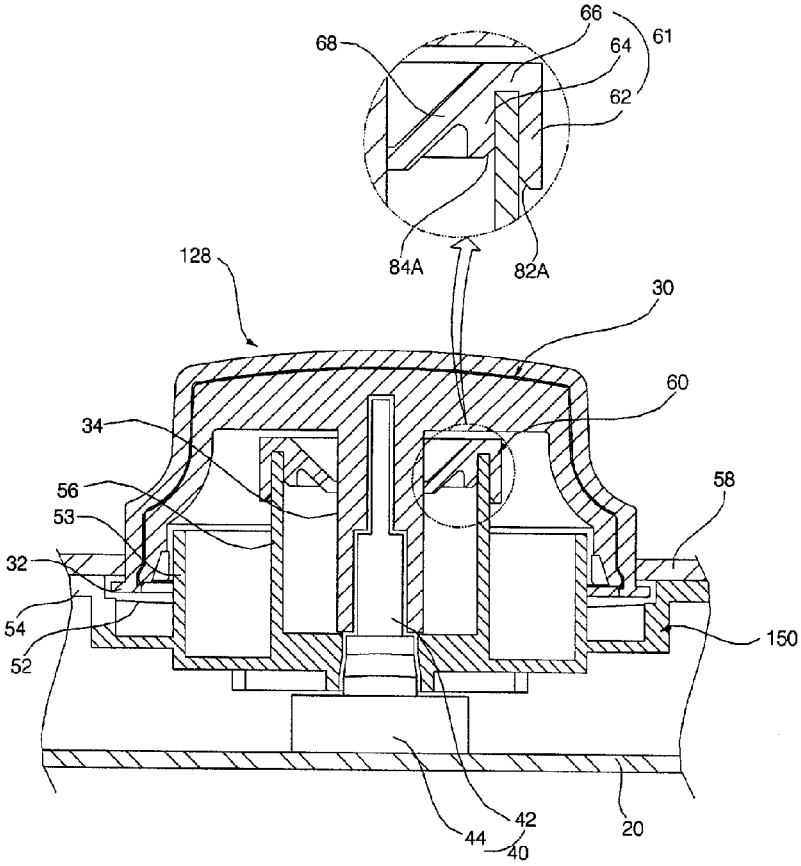
FIG. 8 is a cross-sectional view of a knob switch shown in FIG. 7.

FIG. 7 is a dismantled perspective view of a control unit 107 of a washing machine according to another embodiment of the present invention. FIG. 8 is a cross-sectional view of a knob switch 128 shown in FIG. 7.

In FIGS. 7 and 8, the same reference numerals will be used to designate the same parts as those of the above-mentioned embodiment. Only differences between the present embodiment and the above-mentioned embodiment will be described.

The control unit 107 of FIG. 7 differs from the control unit 7 of FIG. 2 in that a supporter 150 is formed at the front of a control panel 110, and a knob 30 is disposed at the front outside of the control panel 110 and is rotatably seated in the supporter 150.

Referring to FIGS. 7 and 8, the supporter 150 can be integrally formed with the control panel 110, or can be separated from the control panel 110 and mounted on the front surface of the control panel 110. Hereinafter, it is assumed that the supporter 150 is integrally molded when the control panel 110 is injected and molded.

A hollow unit 56 is projected from the supporter 150, and a rotation shaft 42 of an encoder 40 mounted in a board 20 is inserted into the hollow unit 56.

Further, a connecting shaft 34 of the knob 30 is inserted into the hollow unit 56 and then coupled to a rotation shaft 34. The connecting shaft 34 is rotatably resiliently supported by a bushing 60 mounted in the hollow unit 56.

Figure 9:
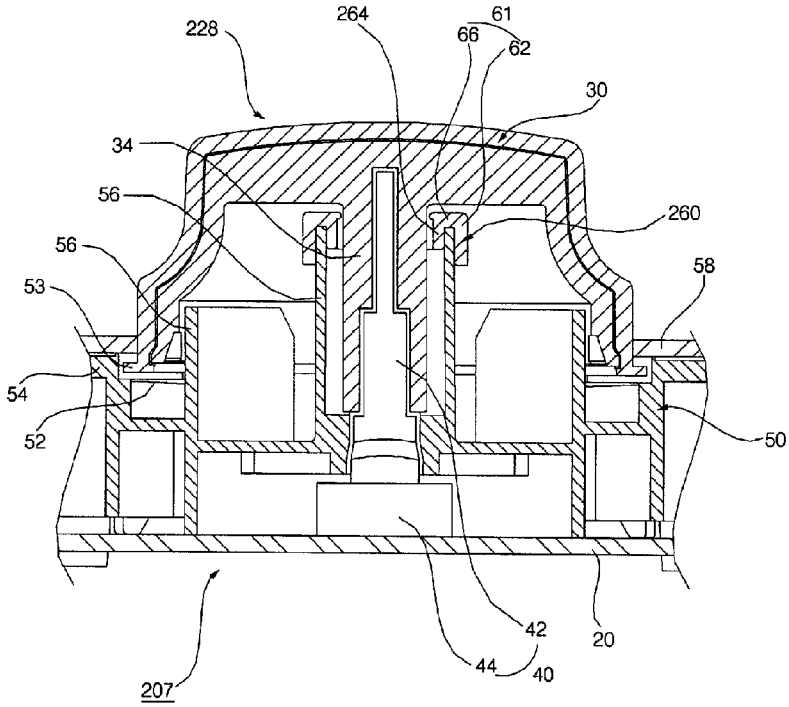
FIG. 9 is a cross-sectional view of a knob switch provided in a control unit of a laundry machine according to still another embodiment of the present invention.
Figure 10:
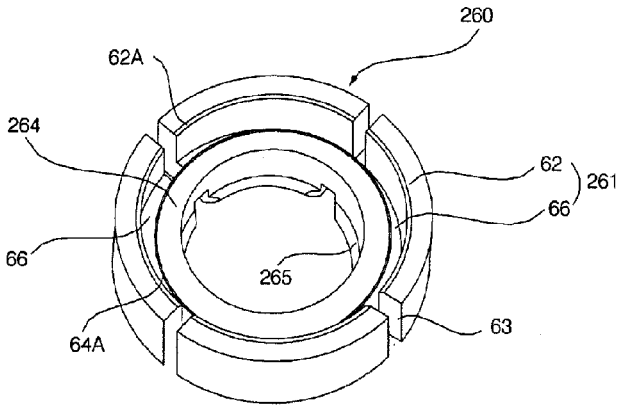
FIG. 10 is a perspective view of a bushing shown in FIG. 9.

FIG. 9 is a cross-sectional view of a knob switch 228 provided in a control unit 207 of a washing machine according to still another embodiment of the present invention. FIG. 10 is a perspective view of a bushing 260 shown in FIG. 9.

In FIGS. 9 and 10, the same reference numerals will be used to designate the same parts as those of the above-mentioned embodiment. Only differences between the present embodiment and the above-mentioned embodiment will be described.

The control unit 207 of FIG. 9 is different from the control unit 7 of FIG. 2 in that the bushing 260 includes a mounting unit 261 and a contact unit 264. The mounting unit 261 is mounted in a hollow unit 56 of a supporter 50, and the contact unit 264 extends from the mounting unit 261 so that it is disposed on the inner circumference of the hollow unit 56 and is rotatably directly brought in contact with the connecting shaft 34 of the knob 30.

Referring to FIGS. 9 and 10, the mounting unit 261 includes an outer circumference unit 62 disposed on the outer circumference of the hollow unit 56, and a connection unit 66 connecting the outer circumference unit 62 and the contact unit 264. Further, the contact unit 264 extends from the connection unit 66 to the inner circumference of the hollow unit 56 so that the outer circumference of the connecting shaft 34 rotatably touches the contact unit 264.

In other words, the inner circumferential surface of the contact unit 264 is adhered closely to the inner circumference of the hollow unit 56, and the outer circumferential surface of the contact unit 264 is directly brought in contact with the outer circumference of the connecting shaft 34.

A ring-shaped rib 265 projects to a height along the circumference on the inner circumferential surface of the contact unit 264. The ring-shaped rib 265 can reduce an area in which the contact unit 264 touches the outer circumferential surface of the hollow unit 34, and can prevent the hollow unit 56 and the contact unit 264 from being adhered closely to each other with high pressure.

Accordingly, a friction action between the hollow unit 56 and the contact unit 264 can be reduced by the ring-shaped rib 265. The ring-shaped rib 265 also functions to compensate for dimension error while being partially deformed when the connecting shaft 34 is assembled in the bushing 260.

Figure 11:
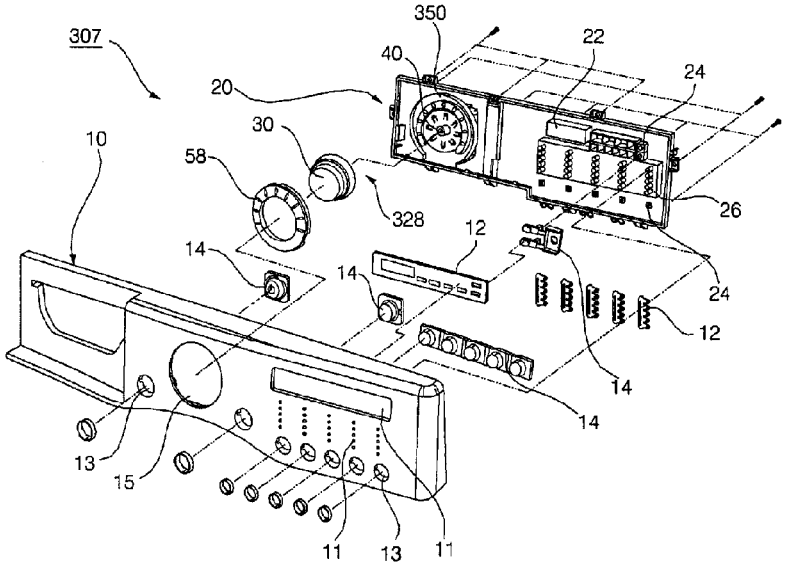
FIG. 11 is a dismantled perspective view of a control unit of a laundry machine according to still further another embodiment of the present invention.
Figure 12:
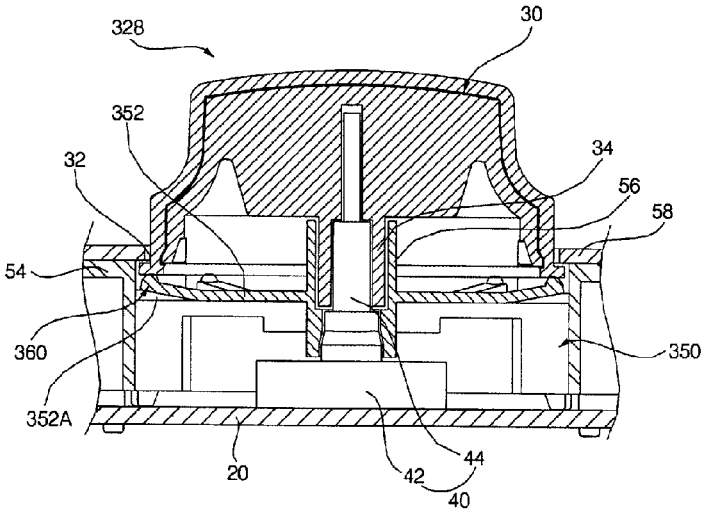
FIG. 12 is a cross-sectional view of a knob switch shown in FIG. 11.
Figure 13:
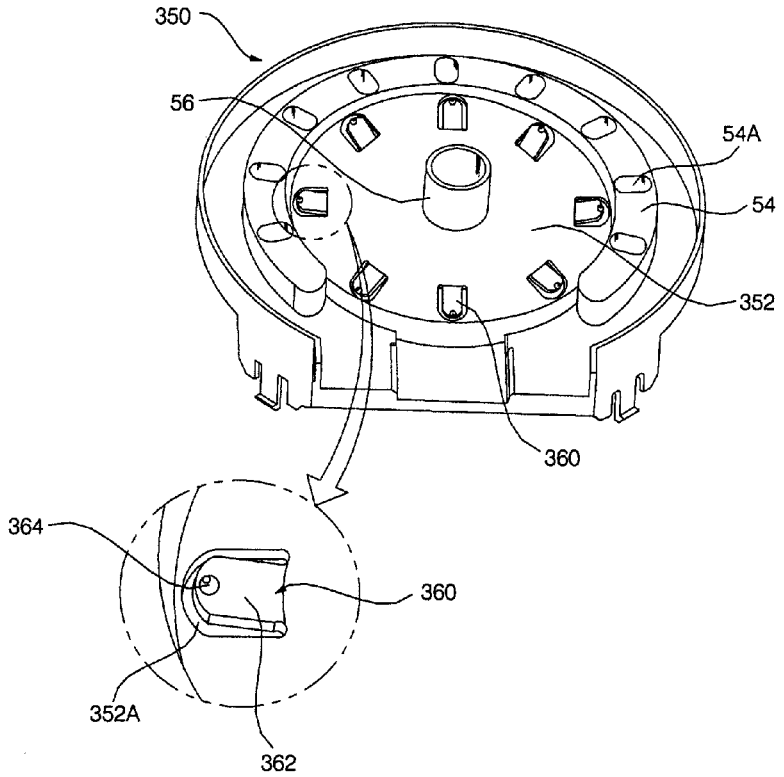
FIG. 13 is a perspective view of a supporter and a resilient support member shown in FIG. 11.

FIG. 11 is a dismantled perspective view of a control unit 307 of a washing machine according to still further another embodiment of the present invention. FIG. 12 is a cross-sectional view of a knob switch 328 shown in FIG. 11. FIG. 13 is a perspective view of a supporter 350 and a resilient support member 360 shown in FIG. 11.

In FIGS. 11 to 13, the same reference numerals will be used to designate the same parts as those of the above-mentioned embodiment. Only differences between the present embodiment and the above-mentioned embodiment will be described.

The control unit 3107 of FIG. 11 differs from the control unit 7 of FIG. 2 in that it omits the bushing 60 of FIG. 2, and the resilient support member 360 rotatably resiliently supporting the knob 30 is provided between the supporter 350 and the knob 30.

Referring to FIGS. 11 to 13, the resilient support member 360 includes a resilient unit 362 having one side coupled to the supporter 350 and the other side inclinedly extending so that it comes in contact with the rear surface of the knob 30, and a projection unit 364 formed on the other side of the resilient unit 362 and coming in contact with the knob 30. In this case, the resilient support member 360 can also be formed on the rear surface of the knob 30. The resilient support member 360 further includes plastic or metal having a lubricative property and an abrasion-resistant property.

The resilient unit 362 is formed in a front seating unit 52 of the supporter 350 in which the knob 30 is rotatably seated so that it is reliantly deformed in forward and backward directions. That is, the resilient unit 362 is lengthily formed in a radial direction of the front seating unit 52, and is inclined forward from the front seating unit 52 so that the projection unit 364 is interfered at the rear of the knob 30. A hollow unit 56 having a connecting shaft 34 of the knob 30 and a rotation shaft 44 of the encoder 40 disposed on an inner surface is projected from the front seating unit 52. Further, a plurality of resilient units 362 are radially disposed around the hollow unit 56 in the front seating unit 52.

Accordingly, as the knob 30 is seated in the front seating unit 52, the knob 30 can be resiliently supported by the plurality of resilient units 362. Furthermore, the front seating unit 52 has a shelter hole 52A formed at a portion corresponding to the resilient unit 362 in order to avoid the interference with the resilient unit 362. The shelter hole 52A is preferably greater than the resilient unit 362.

The projection unit 364 projects in a hemispherical shape at the front of the other side of the resilient unit 362. Accordingly, the contact area of the resilient units 362 and the knob 30 is decreased by the projection unit 364, and when the knob 30 is rotated, a frication action can be reduced.

Meanwhile, in the knob switch 328 of the control unit 307 constructed as described above, as the knob 30 is seated in the front seating unit 52, a flange unit 32 of the knob 30 is rotatably seated in the plurality of resilient units 362, and the connecting shaft 34 of the knob 30 is rotatably inserted into the hollow unit 56 and is coupled to the rotation shaft of an encoder 40.

In this case, the flange unit 32 of the knob 30 is seated in the projection unit 364 of the resilient unit 362, and the resilient unit 362 resiliently supports the knob 30 while being resiliently deformed rearward. Accordingly, the resilient unit 60 is pressed and deformed rearward as the knob 30 is seated in the front seating unit 52, and has increased elastic force to push the knob 30 forward as the resilient unit 362 is deformed.

The plurality of resilient units 362 are formed around the hollow unit 56. Therefore, the knob 30 is resiliently supported by the plurality of resilient units 362 stably while being not inclined in a specific direction. Accordingly, when the knob 30 is rotatably manipulated, the knob 30 can be prevented from being shaken and inclined by means of the plurality of resilient units 362, so that a feeling of manipulation of the knob 30 can be improved.

Furthermore, the flange unit 32 of the knob 30 point-comes in contact with the projection unit 364 of the resilient unit 362. Thus, when the knob 30 is rotatably manipulated, a frication action between the projection unit 364 and the flange unit 32 can be reduced significantly. Accordingly, the occurrence of noise and a reduction in a feeling of manipulation due to frication can be prevented.

Figure 14:
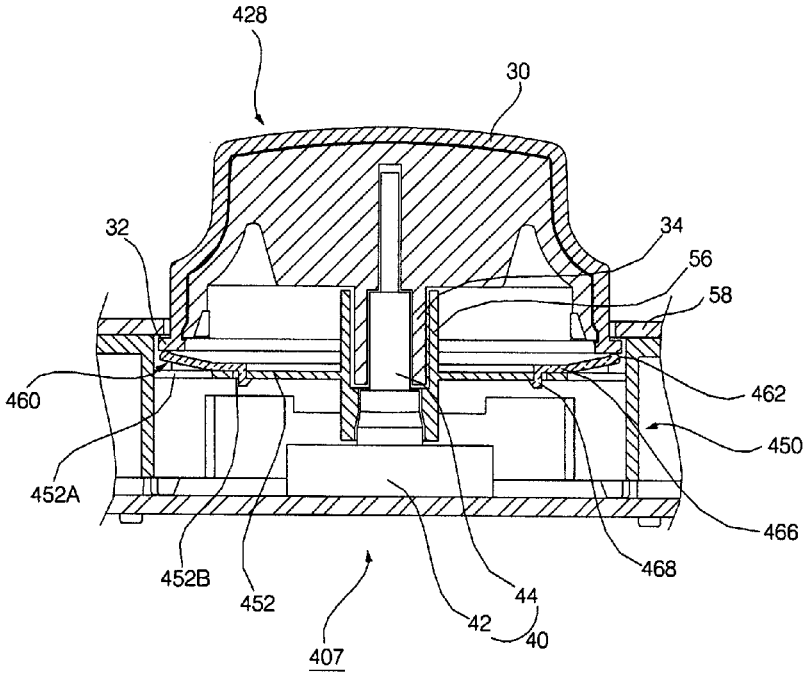
FIG. 14 is a cross-sectional view of a knob switch provided in a control unit of a laundry machine according to still further another embodiment of the present invention.
Figure 15:
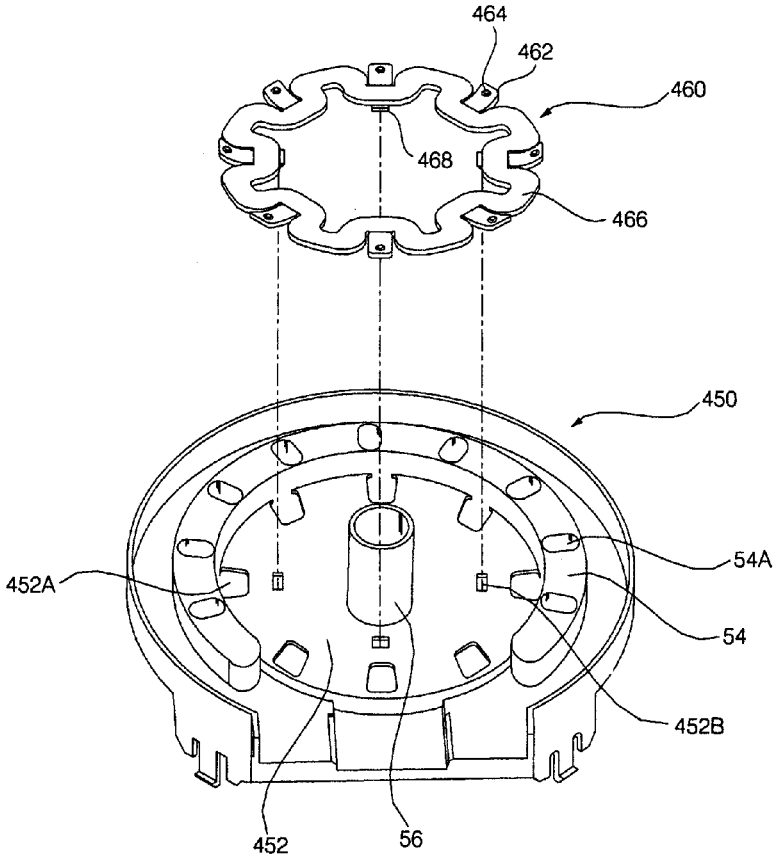
FIG. 15 is a dismantled perspective view of a supporter and a resilient support member shown in FIG. 14.

FIG. 14 is a cross-sectional view of a knob switch 428 provided in a control unit 407 of a washing machine according to still further another embodiment of the present invention. FIG. 15 is a dismantled perspective view of a supporter 450 and a resilient support member 460 shown in FIG. 14.

In FIGS. 14 and 15, the same reference numerals will be used to designate the same parts as those of the above-mentioned embodiments. Only differences between the present embodiment and the above-mentioned embodiments will be described.

The control unit 407 of FIG. 14 differs from the control unit 7 of FIG. 2 in that the bushing 60 of FIG. 2 is omitted, and the resilient support member 460 rotatably resiliently supporting a knob 30 is provided between the supporter 450 and the knob 30.

Furthermore, the resilient support member 460 of FIGS. 14 and 15 differs from the resilient support member 360 of FIGS. 11 to 13 in that a mounting unit 466, which is detachably mounted in at least one of the supporter 450 and the knob 30 and is coupled to one side of the resilient unit 462, is further included.

Referring to FIGS. 14 and 15, the resilient support member 460 includes a mounting unit 466 detachably mounted in a front seating unit 452 of the supporter 450, a resilient unit 462 having one side coupled to the mounting unit 466 and the other side extending inclinedly so that it comes in contact with the rear surface of the knob 30, and a projection unit 464 formed on the other side of the resilient unit 462 and coming in contact with the knob 30. Of course, the resilient support member 460 can also be formed on the rear surface of the knob 30.

The resilient support member 460 further includes plastic or metal having a lubricative property and an abrasion-resistant property. In the present embodiment, the resilient support member 460 is injected and molded using polyacetal resin (POM, polyoxymethylene).

The mounting unit 466 is formed in a sheet form so that it can be seated in the front seating unit 452 of the supporter 450, and has a hole through which a hollow unit 56 of the supporter 450 passes formed at its center. A plurality of resilient units 462 are radially disposed on the outer circumference of the mounting unit 466. A shelter hole 452A is formed in the front seating unit 452 at a portion corresponding to the resilient unit 462. A plurality of hooks 468 are projected downward from the mounting unit 466. Hook holes 452B to which the hooks 468 are coupled are formed in a front seating unit 52.

Meanwhile, the resilient unit 462 and the projection unit 464 have the same constructions as the resilient unit 362 and the projection unit 364 shown in FIGS. 11 to 13, and will not be described in detail.

Accordingly, the knob switch 428 of the control unit 407 is advantageous in that it can be easily fabricated and easily applied to products, compared with the knob switch 328 of FIGS. 11 to 13 because the resilient support member 460 is attached to and detached from the front seating unit 452 of the supporter 450 conveniently.

Figure 16:
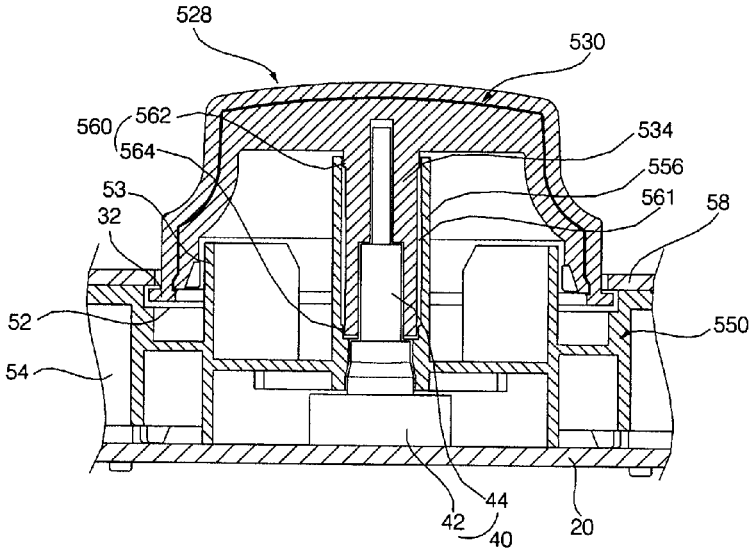
FIG. 16 is a cross-sectional view of a knob switch provided in a control unit of a laundry machine according to still further another embodiment of the present invention.
Figure 17:
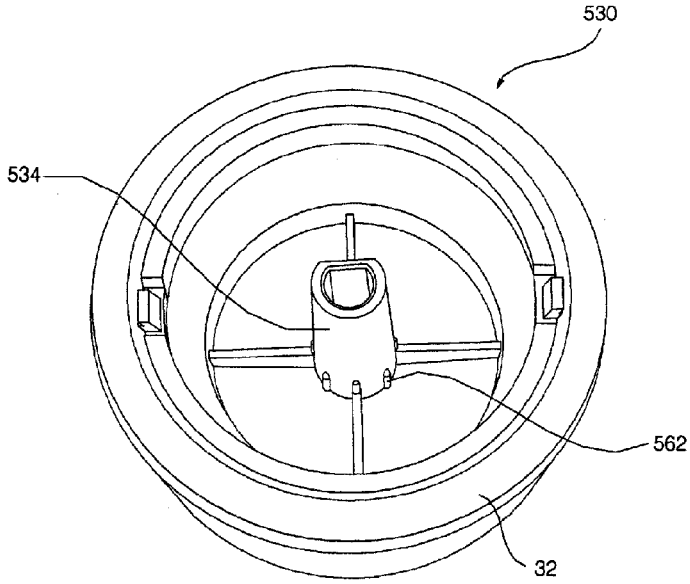
FIG. 17 is a perspective view of a knob shown in FIG. 16.
Figure 18:
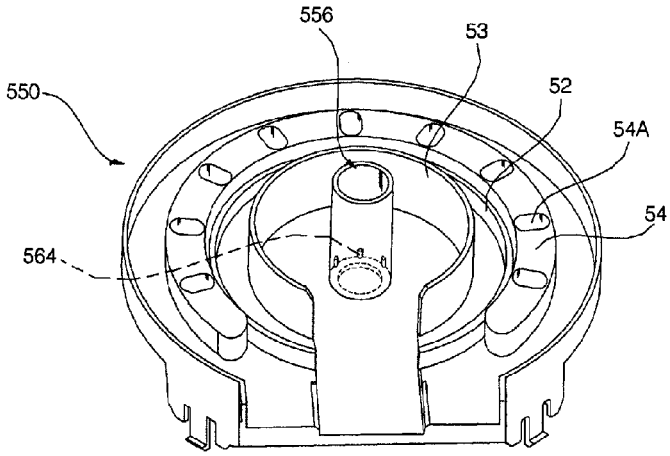
FIG. 18 is a perspective view of a supporter shown in FIG. 16.
Figure 19:
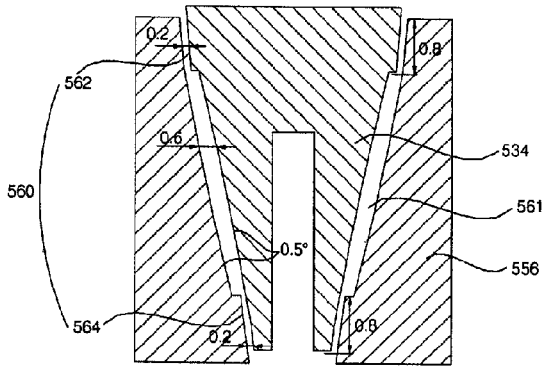
FIG. 19 schematically shows the construction of main components of the knob and the supporter shown in FIG. 16.

FIG. 16 is a cross-sectional view of a knob switch 528 provided in a control unit 507 of a washing machine according to still further another embodiment of the present invention. FIG. 17 is a perspective view of a knob 530 shown in FIG. 16. FIG. 18 is a perspective view of a supporter 550 shown in FIG. 16.

In FIGS. 16 and 17, the same reference numerals will be used to designate the same parts as those of the above-mentioned embodiment. Only differences between the present embodiment and the above-mentioned embodiment will be described.

The control unit 507 of FIG. 16 differs from the control unit 7 of FIG. 2 in that the bushing 60 of FIG. 2 is omitted, a hollow unit 556 in which a rotation shaft 44 of an encoder 40 is disposed is formed in the supporter 550, and a connecting shaft 534 coupled to the rotation shaft 44 is formed in a knob 530 and touches only a portion of the hollow unit 556 and is supported.

Referring to FIGS. 16 and 17, the connecting shaft 534 is rotatably inserted into the hollow unit 556. A contact unit 560 that rotatably comes in contact with an opposite surface of the hollow unit 556 and the connecting shaft 534, and a non-contact unit 561 that is spaced apart from the opposite surface of the hollow unit 556 and the connecting shaft 534 at a predetermined distance are provided on the opposite surface of the hollow unit 556 and the connecting shaft 534.

A lubricant, such as grease, is provided between the hollow unit 556 and the connecting shaft 534. The lubricant is sufficiently stored in the non-contact unit 561, so that the shortage of the lubricant can be prevented although a knob switch 528 is used for a long time.

The opposite surface of the hollow unit 556 and the connecting shaft 534 has a decreased diameter in a direction in which the connecting shaft 534 is inserted, that is, rearward. Accordingly, the contact unit 560 of the hollow unit 556 and the connecting shaft 534 also has an increased diameter rearward. In other words, an inclined surface is formed on the inner circumferential surface of the hollow unit 556 so that it extends forward, and an inclined surface is formed on the outer circumferential surface of the connecting shaft 534 so that it has a pointed end rearward.

Accordingly, when the hollow unit 556 and the connecting shaft 534 are assembled, the connecting shaft 534 can be conveniently inserted into the hollow unit 556. When the knob 530 is manipulated, the connecting shaft 534 is supported by the hollow unit 556 so that the connecting shaft 534 is not pushed rearward.

The contact unit 560 includes projections 562 and 564 formed in at least one of the hollow unit 556 and the connecting shaft 534. The projections 562 and 564 are formed in plural numbers in forward and rearward directions or a circumference direction of the hollow unit 556 and the connecting shaft 534 with them being spaced apart from each other. In the present embodiment, it is assumed that a plurality of first projections 562 are formed on the front outer circumference of the connecting shaft 534, and a plurality of second projections 564 are formed on the rear inner circumference of the hollow unit 556.

Accordingly, since a contact area of the hollow unit 556 and the connecting shaft 534 can be reduced by the first and second projections 562 and 564, frication occurring between the hollow unit 556 and the connecting shaft 534 can be reduced. Furthermore, the front and rear portions of the connecting shaft 534 are rotatably supported to the hollow unit 556 by means of the first and second projections 562 and 564. Accordingly, the connecting shaft 534 can be disposed stably such that both ends thereof is supported by the hollow unit 556.

Figure 20:
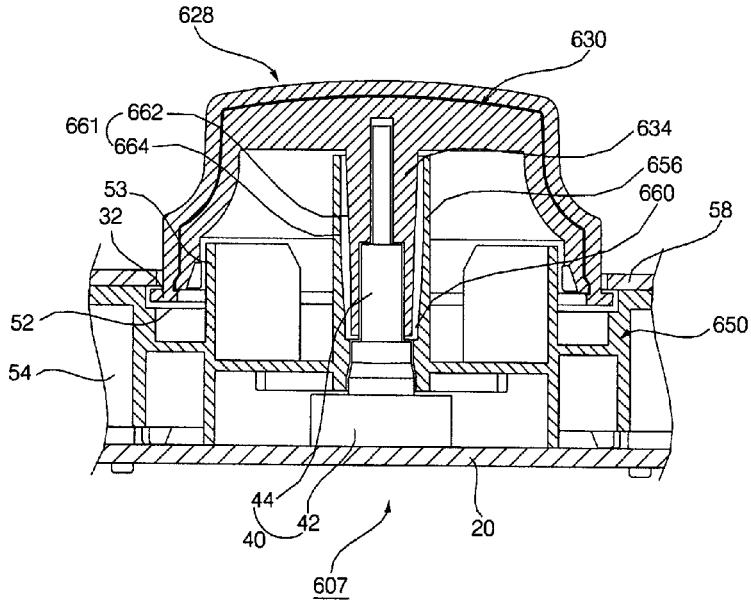
FIG. 20 is a cross-sectional view of a knob switch provided in a control unit of a laundry machine according to still another embodiment of the present invention.
Figure 21:
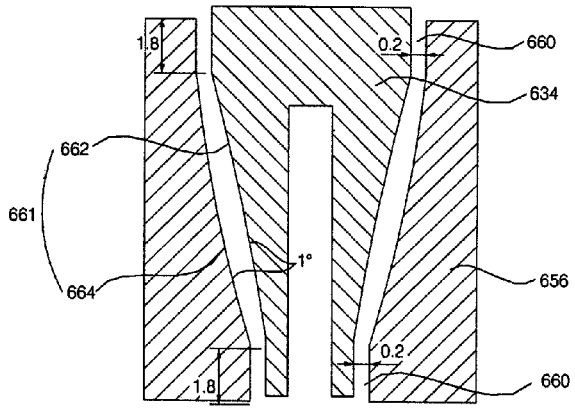
FIG. 21 schematically shows the construction of main components of a knob and a supporter shown in FIG. 20.

FIG. 20 is a cross-sectional view of a knob switch 628 provided in a control unit 607 of a washing machine according to still another embodiment of the present invention. FIG. 21 schematically shows the construction of main components of a knob 630 and a supporter 650 shown in FIG. 20.

In FIGS. 20 and 21, the same reference numerals will be used to designate the same parts as those of the above-mentioned embodiment. Only differences between the present embodiment and the above-mentioned embodiment will be described.

The control unit 607 of FIG. 20 differs from the control unit 7 of FIG. 2 in that the bushing 60 of FIG. 2 is omitted, a hollow unit 656 in which a rotation shaft 44 of an encoder 40 is disposed is formed in the supporter 650, and a connecting shaft 634 coupled to the rotation shaft 44 is formed in the knob 630 and partially comes in contact with the hollow unit 656. That is, a contact unit 660 that rotatably comes in contact with an opposite surface of the hollow unit 656 and the connecting shaft 634, and a non-contact unit 661 that is spaced apart from the opposite surface of the hollow unit 656 and the connecting shaft 634 at a predetermined distance are provided on the opposite surface of the hollow unit 656 and the connecting shaft 634.

Furthermore, the knob switch 628 of FIGS. 20 and 21 is different from the knob switch 528 of FIGS. 16 to 19 is that the non-contact unit 660 includes a groove unit formed in at least one of the opposite surface of the hollow unit 656 and the connecting shaft 634 along the circumference.

A plurality of the non-contact units 660 can be formed in the hollow unit 656 or the connecting shaft 634 with them being spaced apart from each other in at least one of an axial direction and a length direction. In the present embodiment, it is assumed that the non-contact units 660 are formed in the hollow unit 656 and the connecting shaft 634 in a circumference direction in an opposite way.

In other words, the non-contact units 660 includes first and second groove units 662 and 664, which are depressed along the circumference at the center of the opposite surface of the connecting shaft 634 and the hollow unit 656. That is, only the front and rear portions of the opposite surface of the connecting shaft 634 and the hollow unit 656 other than the central portion are touched and supported. Accordingly, the connecting shaft 634 can be disposed in a stable structure in which both ends of the connecting shaft 634 are supported by the hollow unit 656. A contact area of the connecting shaft 634 and the hollow unit 656 is reduced, and friction resistance can be decreased.

Industrial Applicability

If the control unit of the laundry treatment apparatus according to the present invention is adopted, a control unit of a laundry treatment apparatus, having the advantages of preventing shaking of a knob and improving a feeling of manipulation of the knob, can be fabricated.

The invention claimed is:

1. A control unit of a laundry treatment apparatus, comprising:

a board provided in a control panel of the laundry treatment apparatus;

an encoder mounted in the board and having a projected rotation shaft;

a supporter mounted in the board or the control panel and having a hollow unit disposed outside the rotation shaft;

a knob having a connecting shaft coupled to the rotation shaft; and a bushing mounted in the hollow unit and rotatably supporting at least one of the connecting shaft or the rotation shaft, wherein the bushing comprises:

a mounting unit mounted in the hollow unit; and a contact unit extending from the mounting unit and rotatably comming in contact with the connecting shaft or the rotation shaft, wherein the mounting unit comprises:

an outer circumference unit disposed on an outer circumference of the hollow unit; and a connection unit connecting the outer circumference unit and the contact unit.

2. The control unit of the laundry treatment apparatus as claimed in claim 1, wherein the bushing includes a plastic material or a metal material having a lubricative property.

3. A control unit of a laundry treatment apparatus, comprising:

a board provided at a control panel of the laundry treatment apparatus;

an encoder coupled the board and having a rotation shaft projecting therefrom;

a supporter coupled to the board or the control panel and having a hollow unit positioned outside the rotation shaft;

a knob having a connecting shaft coupled to the rotation shaft; and a bushing mounted in the hollow unit and rotatably supporting at least one of the connecting shaft or the rotation shaft, wherein the bushing comprises:

a mounting unit mounted in the hollow unit; and a contact unit extending from the mounting unit and rotatably contacting the connecting shaft or the rotation shaft, wherein the mounting unit comprises:

an outer circumference unit disposed on an outer circumference of the hollow unit;

an inner circumference unit disposed on an inner circumference of the hollow unit; and a connection unit connecting the outer circumference unit the inner circumference unit, and the contact unit.

4. The control unit of the laundry treatment apparatus as claimed in claim 1, wherein the mounting unit has a plurality of incision units formed therein, arranged in a circumferential direction, the plurality of incision units being spaced apart from each other.

5. The control unit of the laundry treatment apparatus as claimed in claim 1, wherein the contact unit resiliently supports the connecting shaft or the rotation shaft.

6. A control unit of a laundry treatment apparatus, comprising:

a board provided at a control panel of the laundry treatment apparatus;

an encoder coupled the board and having a rotation shaft projecting therefrom;

a supporter coupled to the board or the control panel and having a hollow unit positioned outside the rotation shaft;

a knob having a connecting shaft coupled to the rotation shaft; and a bushing mounted in the hollow unit and rotatably supporting at least one of the connecting shaft or the rotation shaft, wherein the bushing comprises:

a mounting unit mounted in the hollow unit; and a contact unit extending from the mounting unit and rotatablv contacting the connecting shaft or the rotation shaft, wherein the contact unit is inclined from the mounting unit to the connecting shaft or the rotation shaft.

7. A control unit of a laundry treatment apparatus, comprising:

a board provided at a control panel of the laundry treatment apparatus;

an encoder coupled the board and having a rotation shaft projecting therefrom;

a supporter coupled to the board or the control panel and having a hollow unit positioned outside the rotation shaft;

a knob having a connecting shaft coupled to the rotation shaft; and a bushing mounted in the hollow unit and rotatably supporting at least one of the connecting shaft or the rotation shaft wherein the bushing comprises:

a mounting unit mounted in the hollow unit; and a contact unit extending from the mounting unit and rotatably contacting the connecting shaft or the rotation shaft, wherein the contact unit includes a rib projected toward the connecting shaft or the rotation shaft along an inner circumference of the mounting unit.

8. The control unit of the laundry treatment apparatus as claimed in claim 7, wherein a slot is formed at the end of the contact unit.

* * * * *